US009902594B2

(12) United States Patent
Mitsui

(10) Patent No.: US 9,902,594 B2
(45) Date of Patent: Feb. 27, 2018

(54) ELEVATOR ROPE AND ELEVATOR APPARATUS THAT USES SAME

(75) Inventor: Atsushi Mitsui, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 301 days.

(21) Appl. No.: 14/414,264

(22) PCT Filed: Aug. 29, 2012

(86) PCT No.: PCT/JP2012/071837

§ 371 (c)(1),
(2), (4) Date: Jan. 12, 2015

(87) PCT Pub. No.: WO2014/033853

PCT Pub. Date: Mar. 6, 2014

(65) Prior Publication Data

US 2015/0144432 A1 May 28, 2015

(51) Int. Cl.
*B66B 7/06* (2006.01)
*D07B 1/06* (2006.01)
(Continued)

(52) U.S. Cl.
CPC ..... *B66B 7/06* (2013.01); *B66B 9/00* (2013.01); *D07B 1/04* (2013.01); *D07B 1/0673* (2013.01);
(Continued)

(58) Field of Classification Search
CPC .... B66B 7/06; B66B 9/00; D07B 1/04; D07B 1/0673; D07B 1/165; D07B 2201/1008;
(Continued)

(56) References Cited

U.S. PATENT DOCUMENTS 1,811,697 A * 6/1931 Reilly ..... D07B 1/0673 57/214
2,241,955 A * 5/1941 Noyer ..... D07B 1/0673 57/214
(Continued)

FOREIGN PATENT DOCUMENTS

CN 101415880 A 4/2009
CN 102459052 A 5/2012
(Continued)

OTHER PUBLICATIONS

Office Action dated Aug. 4, 2015 in Japanese Patent Application No. 2014-532629 with English Summary.
(Continued)

*Primary Examiner* — Michael A Riegelman
(74) *Attorney, Agent, or Firm* — Oblon, McClelland, Maier & Neustadt, L.L.P.

(57) ABSTRACT

In an elevator rope, an inner layer rope has: an inner layer rope fiber core; a plurality of inner layer strands; and a resin inner layer rope coating body that is coated onto an outer circumference. Inner layer strands are twisted together on an outer circumference of the inner layer rope fiber core. The inner layer strands have: an inner layer strand fiber core that is disposed centrally; and a plurality of steel inner layer strand wires that are twisted together on an outer circumference of the inner layer strand fiber core. In addition, a plurality of steel outer layer strands are twisted together on an outer circumference of the inner layer rope.

10 Claims, 4 Drawing Sheets

(51) Int. Cl.
*D07B 1/16* (2006.01)
*B66B 9/00* (2006.01)
*D07B 1/04* (2006.01)

(52) U.S. Cl.
CPC ..... *D07B 1/165* (2013.01); *D07B 2201/102* (2013.01); *D07B 2201/1008* (2013.01); *D07B 2201/2024* (2013.01); *D07B 2201/2037* (2013.01); *D07B 2201/2055* (2013.01); *D07B 2201/2076* (2013.01); *D07B 2501/2007* (2013.01)

(58) Field of Classification Search
CPC ..... D07B 2201/102; D07B 2201/2024; D07B 2201/2037; D07B 2201/2055; D07B 2201/2076
USPC ..... 187/251
See application file for complete search history.

(56) References Cited

U.S. PATENT DOCUMENTS 3,104,515 A * 9/1963 Stevens ..... D07B 1/068 57/220
3,874,158 A * 4/1975 Chiappetta ..... D07B 1/0686 57/214
4,050,230 A * 9/1977 Senoo ..... D07B 1/025 57/231
4,219,995 A * 9/1980 Tajima ..... D07B 1/068 57/213
4,226,078 A * 10/1980 Ohta ..... D07B 1/068 57/213
4,809,492 A * 3/1989 Fischer ..... D07B 1/02 57/212
5,566,786 A * 10/1996 De Angelis ..... B66B 7/06 187/266
5,881,843 A * 3/1999 O'Donnell ..... B66B 7/06 187/254
6,314,711 B1 * 11/2001 De Angelis ..... B66B 7/06 57/210
6,321,520 B1 * 11/2001 De Angelis ..... D07B 1/025 57/211
6,412,264 B1 * 7/2002 De Josez ..... B66B 7/06 57/217
6,563,054 B1 * 5/2003 Damien ..... D07B 1/165 174/120 C
2004/0016603 A1 * 1/2004 Aulanko ..... B66B 7/06 187/254
2004/0026178 A1 * 2/2004 Honda ..... B66B 7/06 187/251
2008/0236130 A1 * 10/2008 Furukawa ..... D07B 1/0673 57/212
2011/0192131 A1 * 8/2011 Naito ..... B66B 7/06 57/232
2012/0180926 A1 * 7/2012 Rebouillat ..... D02G 3/48 152/527
2013/0227926 A1 * 9/2013 Amils ..... D07B 1/068 57/218
2014/0311119 A1 * 10/2014 Mitsui ..... B66B 7/06 57/216
2014/0374195 A1 * 12/2014 Deconinck ..... D07B 1/0673 187/254
2015/0247285 A1 * 9/2015 Amils ..... D07B 1/005 57/221

FOREIGN PATENT DOCUMENTS

CN 202359433 U 8/2012
EP 2 055 829 A1 5/2009
EP 2055829 A1 * 5/2009 ..... B66B 7/06
EP 2 441 723 A1 4/2012
JP 04-044397 U 4/1992
JP 6-322680 A 11/1994
JP 07-043870 U 9/1995
JP 10-18190 A 1/1998
JP 2992783 B2 12/1999
JP 2011-89221 A 5/2011
KR 10-2008-0105043 A 12/2008
KR 10-2009-0080170 A 7/2009
WO WO 2008/023434 A1 2/2008
WO WO 2010/143249 A1 12/2010

OTHER PUBLICATIONS

Combined Chinese Office Action and Search Report dated Jul. 27, 2016 in Patent Application No. 201280075517.6 (with partial English language translation and English translation of categories of cited documents).
International Search Report dated Dec. 4, 2012 in PCT/JP2012/071837 Filed Aug. 29, 2012.
Office Action dated Mar. 29, 2017 in Korean Patent Application No. 10-2015-7005588 (with English translation).

* cited by examiner

ELEVATOR ROPE AND ELEVATOR APPARATUS THAT USES SAME

TECHNICAL FIELD

The present invention relates to an elevator rope that has: a fiber core that is disposed centrally; and a plurality of strands that are formed by twisting together a plurality of steel wires, and to an elevator apparatus that uses the same.

BACKGROUND ART

In conventional high-strength wire ropes, an outer periphery of a steel core rope is coated with an elastomer, and a plurality of steel strands are twisted together on an outer circumference of the elastomer (see Patent Literature 1, for example).

In other conventional wire ropes, a coating is disposed on an outer circumference of a core rope. Pores for issuing small amounts of oil that is contained in the core rope over a long time are disposed on the coating (see Patent Literature 2, for example).

In addition, in conventional elevator ropes, a core rope that is formed by twisting three core rope strands together with each other is disposed centrally. Each of the core rope strands is constituted by a number of yarns that are formed by bundling fibers. An outer circumference of the core rope is coated by a resin core rope coating body. A plurality of steel strands are twisted together on an outer circumference of the core rope coating body. Each of the steel strands is formed by twisting together a plurality of steel wires (see Patent Literature 3, for example).

CITATION LIST

Patent Literature

[Patent Literature 1]
Japanese Patent No. 2992783 (Gazette)
[Patent Literature 2]
Japanese Utility Model Laid-Open No. HEI 7-43870 (Gazette)
[Patent Literature 3]
International Publication No. (WO) 2010/143249

SUMMARY OF THE INVENTION

Problem to be Solved by the Invention

In conventional ropes with steel cores such as that disclosed in Patent Literature 1, the configuration is such that occupied area of steel portions relative to rope diameter is maximized in order to increase strength by increasing effective cross-sectional area. Because of that, the configuration is such that the core rope has: a steel core strand that is disposed centrally therein; and a plurality of steel inner layer strands that are twisted together on an outer circumference of the core strand. However, in a core rope of this kind, portions that contain rope grease are limited, making it difficult to include the amount of oil that is conventionally required. Furthermore, since the core rope is configured using only steel wire, overall mass is increased.

In conventional wire ropes such as that disclosed in Patent Literature 2, compressive forces at a level that is accompanied by deformation are not applied when the strands are twisted together onto the outer circumference of the core rope, and the core rope is not tightened except in a step of twisting together the core rope itself. Because of that, more structural gaps than necessary can be expected to remain inside the core rope.

In conventional elevator ropes such as that disclosed in Patent Literature 3, because the core rope is constituted by fibers, there has been a risk that the fibers may melt and break due to heat from a molding machine as the core rope coating body is coated onto the outer circumference of the core rope. Furthermore, because the core rope is not tightened except during the step of twisting the core rope strands together, structural gaps remain inside the core rope, giving rise to deformation (loss of resilience) and reductions in diameter in the core rope due to extensive use, and contact pressure among the steel strands is thereby increased, giving rise to abrasion and wire breakages in the steel wires.

The present invention aims to solve the above problems and an object of the present invention is to provide an elevator rope and an elevator apparatus that uses the same that can suppress increases in mass and that can also suppress breakage of fibers that constitute a fiber core and deformation and reductions in diameter of the fiber core, while ensuring sufficient rope grease content.

Means for Solving the Problem

In order to achieve the above object, according to one aspect of the present invention, there is provided an elevator rope including: an inner layer rope that includes: an inner layer rope fiber core; a plurality of inner layer strands that are twisted together on an outer circumference of the inner layer rope fiber core; and a resin inner layer rope coating body that is coated onto an outer circumference; and a plurality of steel outer layer strands that are twisted together on an outer circumference of the inner layer rope, wherein the inner layer strands include: an inner layer strand fiber core that is disposed centrally; and a plurality of steel inner layer strand wires that are twisted together on an outer circumference of the inner layer strand fiber core.

According to another aspect of the present invention, there is provided an elevator apparatus including: a hoisting machine that includes a driving sheave; an elevator rope that includes: an inner layer rope; a plurality of steel outer layer strands that are twisted together on an outer circumference of the inner layer rope, the elevator rope being wound onto the driving sheave; and a car that is suspended by the elevator rope, and that is raised and lowered by the hoisting machine, wherein: the inner layer rope includes: an inner layer rope fiber core; a plurality of inner layer strands that are twisted together on an outer circumference of the inner layer rope fiber core; and a resin inner layer rope coating body that is coated onto an outer circumference; and the inner layer strands include: an inner layer strand fiber core that is disposed centrally; and a plurality of steel inner layer strand wires that are twisted together on an outer circumference of the inner layer strand fiber core.

Effects of the Invention

Because the inner layer strands are twisted together on the outer circumference of the inner layer rope fiber core, and inner layer strand fiber cores are disposed centrally in the inner layer strands, and inner layer strand wires that are made of steel are twisted together on the outer circumference of the inner layer strand fiber core, the elevator rope and the elevator apparatus that uses the same according to the present invention can suppress increases in mass and can also suppress breakage of fibers that constitute the fiber cores and deformation and reductions in diameter of the fiber core, while ensuring sufficient rope grease content.

DESCRIPTION OF EMBODIMENTS

Embodiments for implementing the present invention will now be explained with reference to the drawings.

Embodiment 1

Figure 1:
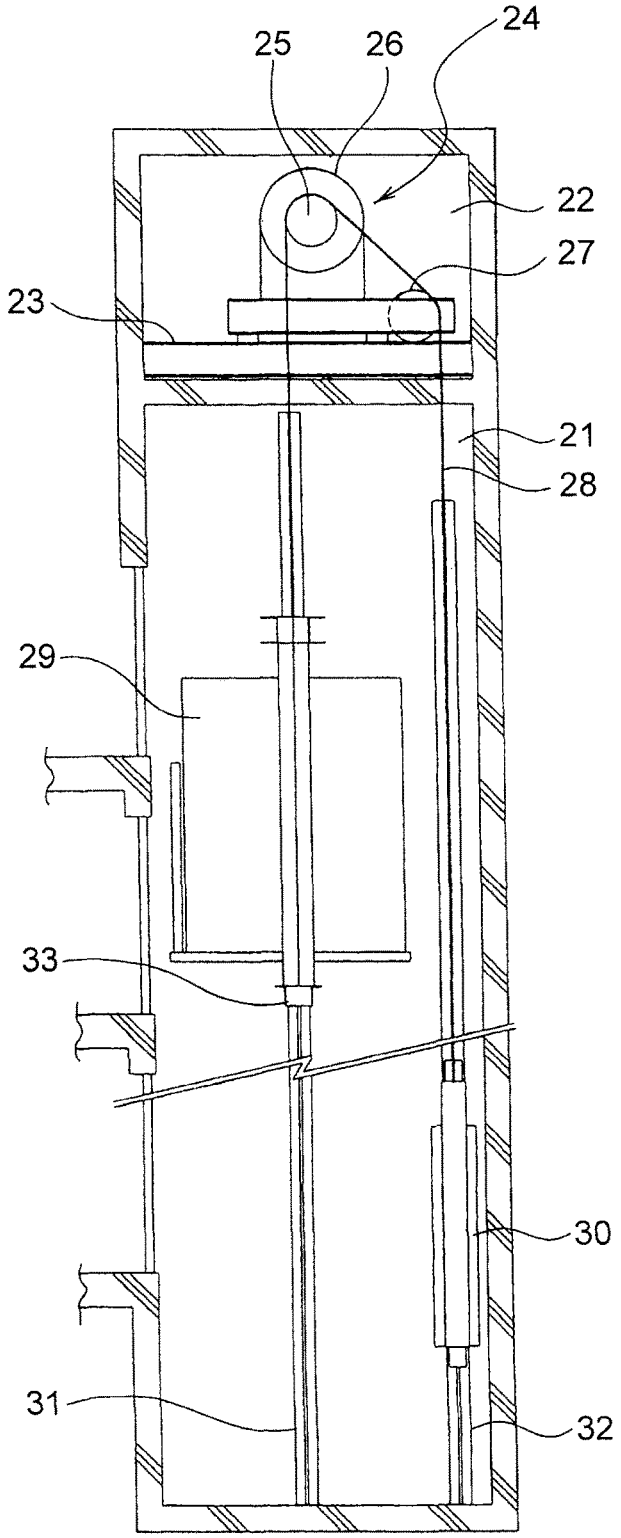
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 22 is disposed in an upper portion of a hoistway 21. A machine base 23 is installed inside the machine room 22. A hoisting machine 24 is supported on the machine base 23. The hoisting machine 24 has a driving sheave 25 and a hoisting machine main body 26. The hoisting machine main body 26 has: a hoisting machine motor that rotates the driving sheave 25; and a hoisting machine brake that brakes the rotation of the driving sheave 25.

A deflecting sheave 27 is mounted onto the machine base 23. A plurality of elevator ropes 28 (only one is shown in the figure) that function as a suspending means are wound around the driving sheave 25 and the deflecting sheave 27. A plurality of rope grooves into which the elevator ropes 28 are inserted are disposed on an outer circumference of the driving sheave 25.

A car 29 and a counterweight 30 are suspended inside the hoistway 21 by the elevator ropes 28 so as to be raised and lowered inside the hoistway 21 by the hoisting machine 24. A pair of car guide rails 31 that guide raising and lowering of the car 29 and a pair of counterweight guide rails 32 that guide raising and lowering of the counterweight 30 are installed inside the hoistway 21. A safety device 33 that makes the car 29 perform an emergency stop by engaging with the car guide rails 31 is mounted onto the car 29.

Figure 2:
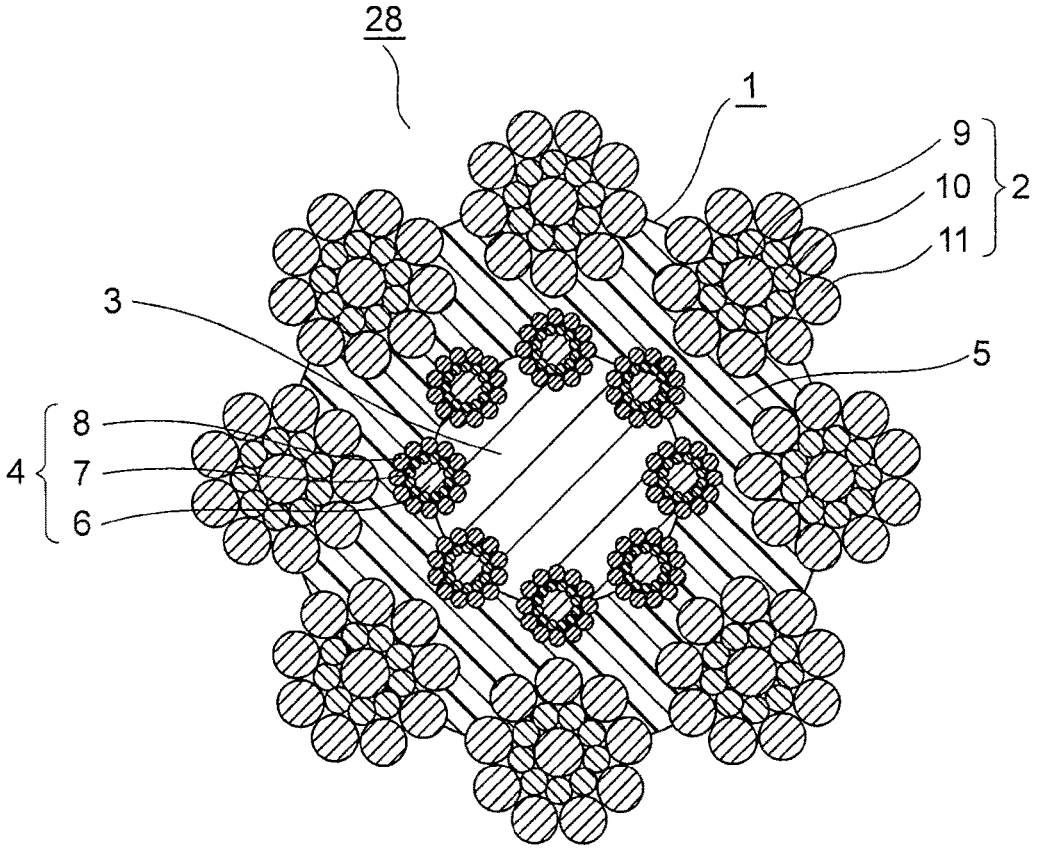
FIG. 2 is a cross section of an elevator rope from FIG. 1.

FIG. 2 is a cross section of an elevator rope 28 from FIG. 1. The elevator rope 28 has: an inner layer rope 1; and a plurality of (in this example, eight) outer layer strands 2 that are twisted together on an outer circumference of the inner layer rope 1. The outer layer strands 2 are positioned in an outermost layer of the elevator rope 28 so as to be exposed externally.

The inner layer rope 1 has: an inner layer rope fiber core 3 that is disposed centrally; a plurality of (in this example, eight) inner layer strands 4 that are twisted together directly onto an outer circumference of the inner layer rope fiber core 3; and a resin inner layer rope coating body 5 that is coated onto an outer circumference.

The inner layer rope fiber core 3 is configured by twisting fibers together. A rope grease is impregnated into the inner layer rope fiber core 3.

Each of the inner layer strands 4 has: an inner layer strand fiber core 6 that is disposed centrally; a plurality of (in this example, twelve) first inner layer strand wires (intermediate wires) 7 that are twisted together on an outer circumference of the inner layer strand fiber core 6; and a plurality of (in this example, twelve) second inner layer strand wires (outer layer wires) 8 that are twisted together on an outer circumference of the layer of first inner layer strand wires 7.

The inner layer strand fiber cores 6 are configured by twisting fibers together. A rope grease is impregnated into all of the inner layer strand fiber cores 6.

The first and second inner layer strand wires 7 and 8 are all steel wires. A diameter of the second inner layer strand wires 8 is smaller than a diameter of the inner layer strand fiber cores 6, and larger than a diameter of the first inner layer strand wires 7. In other words, the diameter of the first inner layer strand wires 7 is smaller than the diameter of the second inner layer strand wires 8.

A resin that has a certain amount of hardness, such as polyethylene or polypropylene, for example, is used as a material for the inner layer rope coating body 5. The inner layer rope coating body 5 is interposed between adjacent outer layer strands 2, between adjacent inner layer strands 4, and also between the outer layer strands 2 and the inner layer strands 4.

Each of the outer layer strands 2 has: a first outer layer strand wire (a core wire) 9 that is disposed centrally; a plurality of (in this example, nine) second outer layer strand wires (intermediate wires) 10 that are twisted together on an outer circumference of the first outer layer strand wire 9; and a plurality of (in this example, nine) third outer layer strand wires (outer layer wires) 11 that are twisted together on an outer circumference of the layer of second outer layer strand wires 10.

The first through third outer layer strand wires 9 through 11 are all steel wires. A diameter of the third outer layer strand wires 11 is smaller than a diameter of the first outer layer strand wires 9, and larger than a diameter of the second outer layer strand wires 10. In other words, the diameter of the second outer layer strand wires 10 is smaller than the diameter of the third outer layer strand wires 11.

A diameter of the inner layer strands 4 is smaller than a diameter of the outer layer strands 2. In this example, the diameter of the inner layer strands 4 is less than or equal to one half of the diameter of the outer layer strands 2. Furthermore, the inner layer strands 4 are equal in number to the outer layer strands 2.

The diameters of the inner layer strand wires 7 and 8 are smaller than the diameters of any of the outer layer strand wires 9, 10, and 11. The tensile strength of the inner layer strand wires 7 and 8 is higher than the tensile strength of any of the outer layer strand wires 9, 10, and 11.

In an elevator rope 28 of this kind, because the inner layer rope fiber core 3 is disposed centrally in the inner layer rope 1 and the inner layer strand fiber cores 6 are disposed centrally in each of the inner layer strands 4, rope grease content can be increased compared to inner layer ropes that are configured using only the steel wire.

By increasing the cross-sectional area of the fiber portion and reducing the cross-sectional area of the steel wire, increases in the unit mass of the elevator rope 28 can be suppressed. Specifically, increases in unit mass due to the inner layer strands 4 can be kept to within fifteen percent compared to ropes with fiber cores in which the portion occupied by the inner layer strands 4 is instead occupied by the fiber core. The elevator rope 28 according to Embodiment 1 can thereby be used instead of elevator ropes that are used in existing elevator apparatuses, for example, without modification.

In addition, because the inner layer strands 4 are disposed between the inner layer rope fiber core 3 and the inner layer rope coating body 5, and the inner layer strand wires 7 and 8 are disposed around the outer circumferences of the inner layer strand fiber cores 6, the fiber cores 3 and 6 are prevented from being fused and cut by the high-temperature resin when applying the inner layer rope coating body 5.

Furthermore, because the inner layer rope fiber core 3 is tightened when the inner layer strands 4 are twisted together, structural gaps inside the inner layer rope fiber core 3 are reduced significantly, enabling reductions in diameter due to deformation (loss of resilience) of the inner layer rope 1 over periods of extended use to be suppressed. Thus, increases in contact pressure among the outer layer strands 2 due to reductions in diameter are prevented, enabling abrasion of the outer layer strands 2 to be suppressed.

By using a resin such as polyethylene or polypropylene, for example, that has self-lubricating properties as the material for the inner layer rope coating body 5, deterioration in lubricity between the inner layer strands 4 and the outer layer strands 2 is prevented if the rope grease dries up due to an extended period of use, enabling deterioration in strength due to wire abrasion or core rope abrasion to be suppressed.

In addition, by making the number of inner layer strands less than or equal to eight, manufacturing using manufacturing equipment that is conventionally used in elevator manufacturing of the elevator is possible, enabling increases in the manufacturing costs of the elevator rope 28 to be suppressed.

Furthermore, because the diameters of the inner layer strand wires 7 and 8 are smaller than the diameters of any of the outer layer strand wires 9, 10, and 11, and the tensile strength of the inner layer strand wires 7 and 8 is higher than the tensile strength of any of the outer layer strand wires 9, 10, and 11, the inner layer strands 4 can be prevented from breaking before the outer layer strands 2, enabling overall rope deterioration to be easily determined from the external appearance of the rope.

Now, if minute cracks arise in the inner layer rope coating body 5 due to an extended period of use, the rope grease is supplied to the outer layer strands 2 through the cracks. In contrast to that, if the thickness of the inner layer rope coating body 5 were too great, the rope grease might not be supplied, and the cross-sectional area of the inner layer rope fiber core 3 would be reduced, also reducing rope grease content.

In order to prevent direct contact between the inner layer strands 4 and the outer layer strands 2, it is necessary for the inner layer rope coating body 5 to be interposed between the two. However, the thickness of the inner layer rope coating body 5 need only be in the order of one percent of the rope diameter in order to prevent direct contact. Because of that, allowing for manufacturing errors during coating application and laying of the outer layer strands 2, it is preferable for the thickness of the inner layer rope coating body 5 that is interposed between the inner layer strands 4 and the outer layer strands 2 to be greater than or equal to one percent and less than or equal to two percent of an overall diameter of the elevator rope 28.

By using fiber cores 3 and 6 that are made of a synthetic resin, internal gaps are reduced compared to natural fibers such as sisal that are commonly used as a core rope material in elevator ropes, further suppressing deformation (loss of resilience) over periods of extended use, and enabling corrosion in high-humidity environments to be suppressed. Thus, internal damage that was at risk of arising among the outer layer strands and between the outer layer strands 2 and the inner layer rope 1 can be more reliably prevented.

Embodiment 2

Figure 3:
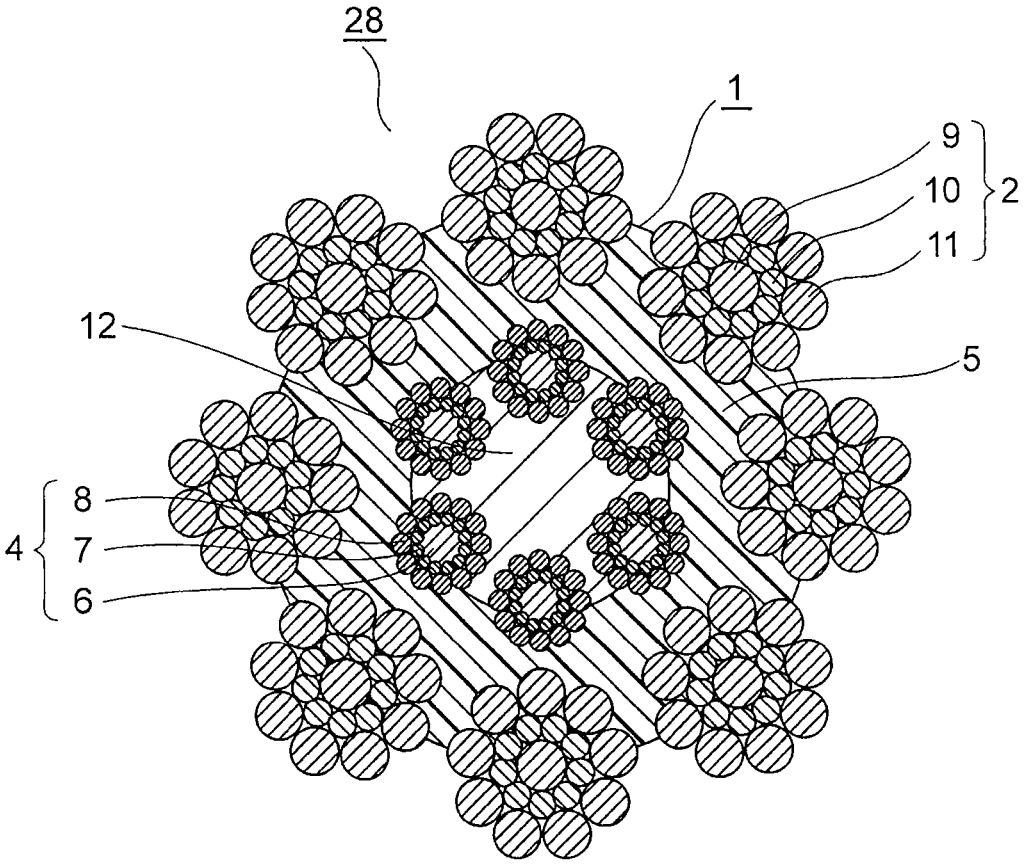
FIG. 3 is a cross section of an elevator rope according to Embodiment 2 of the present invention.

Next, FIG. 3 is a cross section of an elevator rope 28 according to Embodiment 2 of the present invention. In Embodiment 2, a synthetic fiber round bar core (a solid core) that is made of polypropylene or polyethylene, for example, is used as an inner layer rope fiber core 12. The round bar core is configured by twisting together three core strands 2 and applying pressure from an outer circumference. Each of the core strands is constituted by a number of yarns that are formed by bundling synthetic fibers.

Six inner layer strands 4 are twisted together onto an outer circumference of the inner layer rope fiber core 12. In other words, the inner layer strands 4 are fewer in number than the outer layer strands 2. The rest of the configuration is similar or identical to that of Embodiment 1.

In an elevator rope 28 of this kind, because a synthetic fiber round bar core is used as the inner layer rope fiber core 12, packing density of the fibers in a central portion can be improved, enabling decreases in diameter due to deformation (loss of resilience) of the inner layer rope 1 over periods of extended use to be further suppressed. Thus, abrasion of the outer layer strands 2 can be further suppressed.

Because internal gaps are reduced in the inner layer rope fiber core 12 according to Embodiment 2 compared to the inner layer rope fiber core 3 according to Embodiment 1, the rope grease content is reduced. In contrast to that, the cross-sectional area of the inner layer strand fiber cores 6 can be increased by increasing the cross-sectional area of the inner layer strands 4 while reducing the number of the inner layer strands 4, enabling the required rope grease content to be ensured.

Embodiment 3

Figure 4:
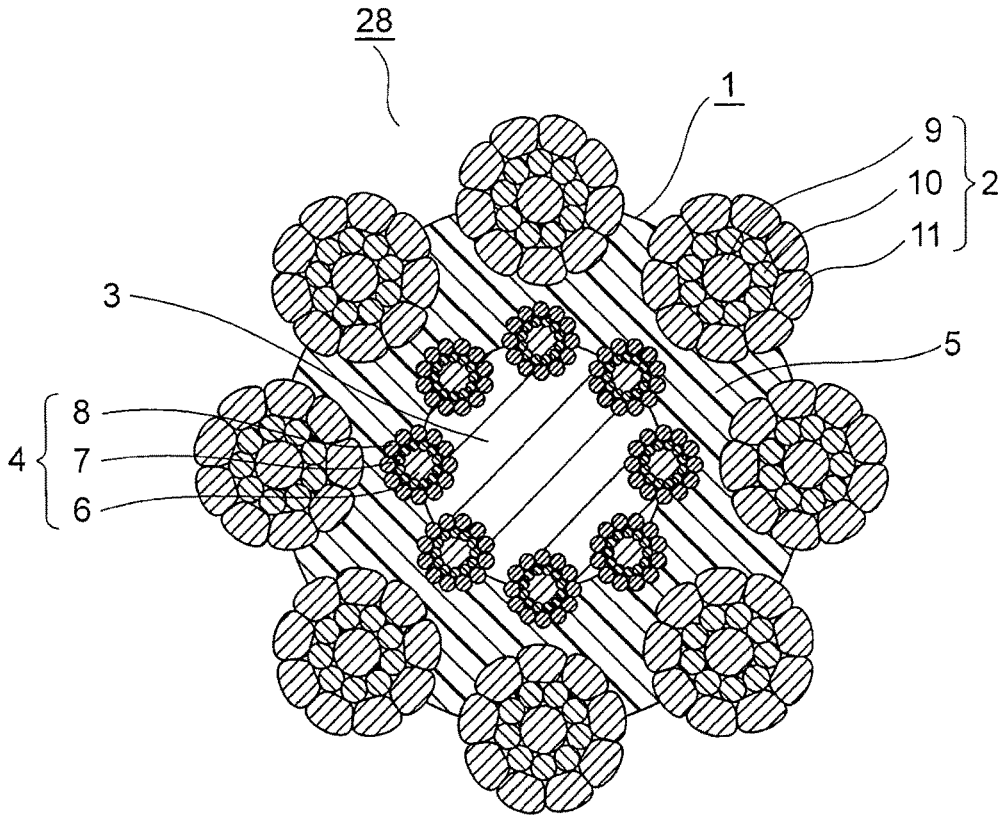
FIG. 4 is a cross section of an elevator rope according to Embodiment 3 of the present invention.

Next, FIG. 4 is a cross section of an elevator rope 28 according to Embodiment 3 of the present invention. In this example, outer layer strands 2 are compressed (by plastic working) from an outer circumference by a die during manufacturing. Cross-sectional shapes of outer layer wires 10 are thereby modified. The rest of the configuration is similar or identical to that of Embodiment 1.

According to a configuration of this kind, contact surface pressure between the rope grooves of the driving sheave 25 (FIG. 1) and the elevator rope 28 can be reduced, enabling damage to the outer layer strands 2 to be suppressed while suppressing internal damage to the elevator rope 28, and enabling additional extension of service life of the elevator rope 28 to be achieved.

Moreover, the shape of the third outer layer strand wires 11 according to Embodiment 2 may be modified in a similar or identical manner to Embodiment 3.

In Embodiment 2, the inner layer rope fiber core 12 is a round bar core, but the inner layer strand fiber cores 6 may also be synthetic fiber round bar cores.

In addition, the type of elevator apparatus to which the elevator rope according to the present invention is applied is not limited to the type in FIG. 1. The present invention can also be applied to machine-roomless elevators, elevator apparatuses that use two-to-one (2:1) roping methods, multi-car elevators, or double-deck elevators, for example.

Furthermore, the elevator rope according to the present invention can also be applied to ropes other than ropes for suspending a car 29, such as compensating ropes or governor ropes, for example.

The invention claimed is:

1. An elevator rope comprising:

an inner layer rope that includes:

an inner layer rope fiber core;

a plurality of inner layer strands that are twisted together on an outer circumference of the inner layer rope fiber core; and a resin inner layer rope coating body that is coated onto the outer circumference of the inner layer rope fiber core and coated onto an outer surface of the plurality of inner layer strands; and a plurality of steel outer layer strands that are twisted together on an outer circumference of the resin inner layer rope, wherein the inner layer strands include:

an inner layer strand fiber core that is disposed centrally; and a plurality of steel inner layer strand wires that are twisted together on an outer circumference of the inner layer strand fiber core, wherein a rope grease is impregnated into each of the inner layer rope fiber core and the inner layer strand fiber core.

2. The elevator rope according to claim 1, wherein a diameter of the inner layer strands is smaller than a diameter of the outer layer strands.

3. The elevator rope according to claim 1, wherein a diameter of the inner layer strand wires is smaller than a diameter of any wire that constitutes the outer layer strands.

4. The elevator rope according to claim 1, wherein a tensile strength of the inner layer strand wires is higher than a tensile strength of any wire that constitutes the outer layer strands.

5. The elevator rope according to claim 1, wherein the inner layer strands are less than or equal to eight in number.

6. The elevator rope according to claim 1, wherein an increase in unit mass due to the inner layer strands is within fifteen percent compared to when a portion occupied by the inner layer strands is instead occupied by the inner layer rope fiber core.

7. The elevator rope according to claim 1, wherein a thickness of a portion of the inner layer rope coating body that is interposed between the inner layer strands and the outer layer strands is greater than or equal to one percent and less than or equal to two percent of an overall rope diameter.

8. The elevator rope according to claim 1, wherein the outer layer strands are compressed from an outer circumference such that a cross-sectional shape of a wire on an outer circumference of the outer layer strands is modified thereby.

9. The elevator rope according to claim 1, wherein the inner layer rope fiber core is made of a synthetic resin.

10. An elevator apparatus comprising:

a hoisting machine that includes a driving sheave;

an elevator rope that includes:

an inner layer rope;

a plurality of steel outer layer strands that are twisted together on an outer circumference of the inner layer rope, the elevator rope being wound onto the driving sheave; and a car that is suspended by the elevator rope, and that is raised and lowered by the hoisting machine, wherein:

the inner layer rope includes:

an inner layer rope fiber core;

a plurality of inner layer strands that are twisted together on an outer circumference of the inner layer rope fiber core; and a resin inner layer rope coating body that is coated onto the outer circumference of the inner layer rope fiber core and coated onto an outer surface of the plurality of inner layer strands; and the inner layer strands include:

an inner layer strand fiber core that is disposed centrally; and a plurality of steel inner layer strand wires that are twisted together on an outer circumference of the inner layer strand fiber core, wherein a rope grease is impregnated into the inner layer rope fiber core and the inner layer strand fiber core.

* * * * *